US008314744B2

(12) United States Patent
Libonati et al.

(10) Patent No.: US 8,314,744 B2
(45) Date of Patent: Nov. 20, 2012

(54) BICONICAL DIPOLE ANTENNA INCLUDING CHOKE ASSEMBLIES AND RELATED METHODS

(75) Inventors: Russell W. Libonati, Melbourne, FL (US); Larry Goldstein, Melbourne, FL (US); Francis Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 320 days.

(21) Appl. No.: 12/860,185

(22) Filed: Aug. 20, 2010

(65) Prior Publication Data

US 2012/0044119 A1 Feb. 23, 2012

(51) Int. Cl.
*H01Q 9/28* (2006.01)

(52) U.S. Cl. ..... 343/807; 343/773

(58) Field of Classification Search ..... 343/773, 343/807

See application file for complete search history.

(56) References Cited

U.S. PATENT DOCUMENTS

| | | | | |
|---|---|---|---|---|
| 4,125,840 | A * | 11/1978 | Cassel | 343/807 |
| 5,367,312 | A | 11/1994 | Masters | |
| 6,154,182 | A | 11/2000 | Mclean | 343/773 |
| 6,268,834 | B1 | 7/2001 | Josypenko | 343/773 |
| 6,621,462 | B2 | 9/2003 | Barnes | 343/787 |
| 7,215,292 | B2 | 5/2007 | Mclean | 343/725 |
| 7,221,326 | B2 | 5/2007 | Ida et al. | 343/773 |
| 7,339,542 | B2 * | 3/2008 | Lalezari | 343/773 |
| 8,228,257 | B2 * | 7/2012 | Lalezari | 343/850 |

FOREIGN PATENT DOCUMENTS

JP 2007194891 8/2007

* cited by examiner

*Primary Examiner* — Anh Tran

(74) *Attorney, Agent, or Firm* — Allen, Dyer, Doppelt, Milbrath & Gilchrist, P.A.

(57) ABSTRACT

An antenna assembly may include first and second adjacent antenna elements each including a conical antenna body having a base and an apex opposite the base. The antenna assembly may also include a cylindrical antenna body extending from the base of the conical antenna body, and a choke assembly including a choke shaft having a proximal end coupled to the conical antenna body and a distal end opposite the proximal end. The choke assembly may include at least one choke member carried by the distal end of the choke shaft in longitudinally spaced relation from an opposing end of the cylindrical antenna body to define at least one choke slot. Each of the first and second conical antenna bodies may be aligned along a common longitudinal axis with respective apexes in opposing relation to define a symmetrical biconical dipole antenna.

27 Claims, 13 Drawing Sheets

BICONICAL DIPOLE ANTENNA INCLUDING CHOKE ASSEMBLIES AND RELATED METHODS

FIELD OF THE INVENTION

The present invention relates to the field of antennas, and, more particularly, to biconical dipole antennas and related methods.

BACKGROUND OF THE INVENTION

A particular type of antenna may be selected for use in an electronic device based upon a desired application. For example, a different type of antenna may be used for terrestrial communications versus satellite communications. The type of antenna used may also be based upon a desired operating frequency of the antenna.

One example of a type of antenna is a broadband antenna. A broadband antenna is an antenna that operates over a wide range of frequencies. The broadband antenna may be formed to provide increased gain along the horizon, for example, during terrestrial communications.

One type of broadband antenna is a biconical antenna. A biconical antenna has inherent broadband characteristics. However, a diameter of a biconical antenna becomes increasingly large at lower operational frequencies. A larger diameter or size may be restricted in a mobile wireless communications device as the size of the housing carrying the biconical antenna may be limited in size. To reduce the size of the biconical antenna, the biconical antenna may be truncated. As a result, a dipole-type structure is formed.

Increased antenna performance at lower frequencies may correspond to increased antenna length. However, at higher frequencies the increased length may result in the formation of lobes in the antenna pattern, thus resulting in relatively low gain on the horizon.

For example, referring now to the biconical antenna 170 in FIG. 1*a*, and the graphs in FIGS. 1*b*-1*c*, the biconical antenna has relatively satisfactory performance at the horizon both for low (FIG. 1*b*) and high (FIG. 1*c*) frequencies. However, the biconical antenna has a relatively large diameter, for example, 15.5" tall by 15.3" in diameter, for a desired operating frequency range.

Additionally, referring to the truncated biconical antenna 180 (i.e. dipole with biconical feed) in FIG. 2*a*, and the graphs in FIGS. 2*a*-2*c*, the truncated biconical antenna feed has relatively satisfactory performance at the horizon at low frequencies (FIG. 2*b*). The dominate dipole structure may be too long for the higher frequencies, which illustratively causes a lobe to form at the horizon (FIG. 2*c*). Example dimensions for the truncated biconical dipole are 15.5" tall×4" in diameter for the desired operating frequency range.

U.S. Pat. No. 7,221,326 to Ida et al. discloses a biconical antenna. More particularly, the biconical antenna includes a columnar dielectric member having frustum-shaped cavities extending respectively from an upper and lower surface toward the center of the columnar member. Flat surfaces of apex portions of the frustum-shaped cavities are parallel and in opposition to one another.

U.S. Pat. No. 7,339,542 to Lalezari et al. discloses an ultra-broadband antenna system that combines an asymmetrical dipole element and a biconical dipole element to form a monopole. The asymmetrical dipole element includes upper and lower asymmetrical dipole elements. The antenna system also includes a plastic expander ring coupled to the lower asymmetrical dipole element. The expander ring is also coupled to a canister sub-assembly. A choke sub-assembly is provided within the canister sub-assembly.

SUMMARY OF THE INVENTION

In view of the foregoing background, it is therefore an object of the present invention to provide an antenna assembly having reduced size and lobe formation across a range of desired operating frequencies.

This and other objects, features, and advantages in accordance with the present invention are provided by an antenna assembly that includes first and second adjacent antenna elements each including a conical antenna body having a base and an apex opposite the base. The first and second adjacent antenna elements also includes a cylindrical antenna body extending from the base of the conical antenna body, and a choke assembly including a choke shaft having a proximal end coupled to the conical antenna body and a distal end opposite the proximal end. The choke assembly includes at least one choke member carried by the distal end of the choke shaft in longitudinally spaced relation from an opposing end of the cylindrical antenna body to define at least one choke slot. Each of the first and second conical antenna bodies are aligned along a common longitudinal axis with respective apexes in opposing relation to define a symmetrical biconical dipole antenna. Accordingly, the antenna assembly has a reduced size and lobe formation across a range of desired operating frequencies.

The proximal end of the choke shaft and the opposing portions of the conical antenna body may define an adjustable length connection to permit longitudinal adjustment of the at least one choke slot. The adjustable length connection may include a threaded connection.

The choke shaft of the first antenna element may include a hollow choke shaft defining a first antenna feed point. The antenna assembly may further include a conductor extending through the hollow choke shaft and coupled to the conical antenna body of the second antenna element to define a second antenna feed point.

In another embodiment, the antenna assembly may include a coaxial cable extending through the hollow choke shaft. The coaxial cable may include an inner conductor coupled to the conical antenna body of the second antenna element, for example. The coaxial cable may also include an outer conductor surrounding the inner conductor and coupled to the cylindrical antenna body of the first antenna element.

The conical antenna body of the first antenna element may have an opening at the apex thereof. The antenna assembly may further include a tubular dielectric spacer positioned in the opening and receiving the inner conductor of the coaxial cable, for example. The inner conductor is coupled to the conical antenna body of the second antenna element.

The cylindrical antenna body may also include a mesh electrical conductor. In some embodiments, the cylindrical antenna body may also include a continuous electrical conductor. The antenna assembly may further include a dielectric cylindrical body surrounding the pair of first and second adjacent antenna elements, for example.

A method aspect is directed to a method of making an antenna assembly. The method includes forming first and second adjacent antenna elements. The first and second antenna elements include a conical antenna body having a base and an apex opposite the base, a cylindrical antenna body extending from the base of the conical antenna body, and a choke assembly. The choke assembly includes a choke shaft having a proximal end coupled to the conical antenna body and a distal end opposite the proximal end. The choke assembly also includes at least one choke member carried by the distal end of the choke shaft in longitudinally spaced relation from an opposing end of the cylindrical antenna body to define at least one choke slot. The method includes aligning each of the first and second conical antenna bodies along a common longitudinal axis with respective apexes in opposing relation to define a symmetrical biconical dipole antenna.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1A:
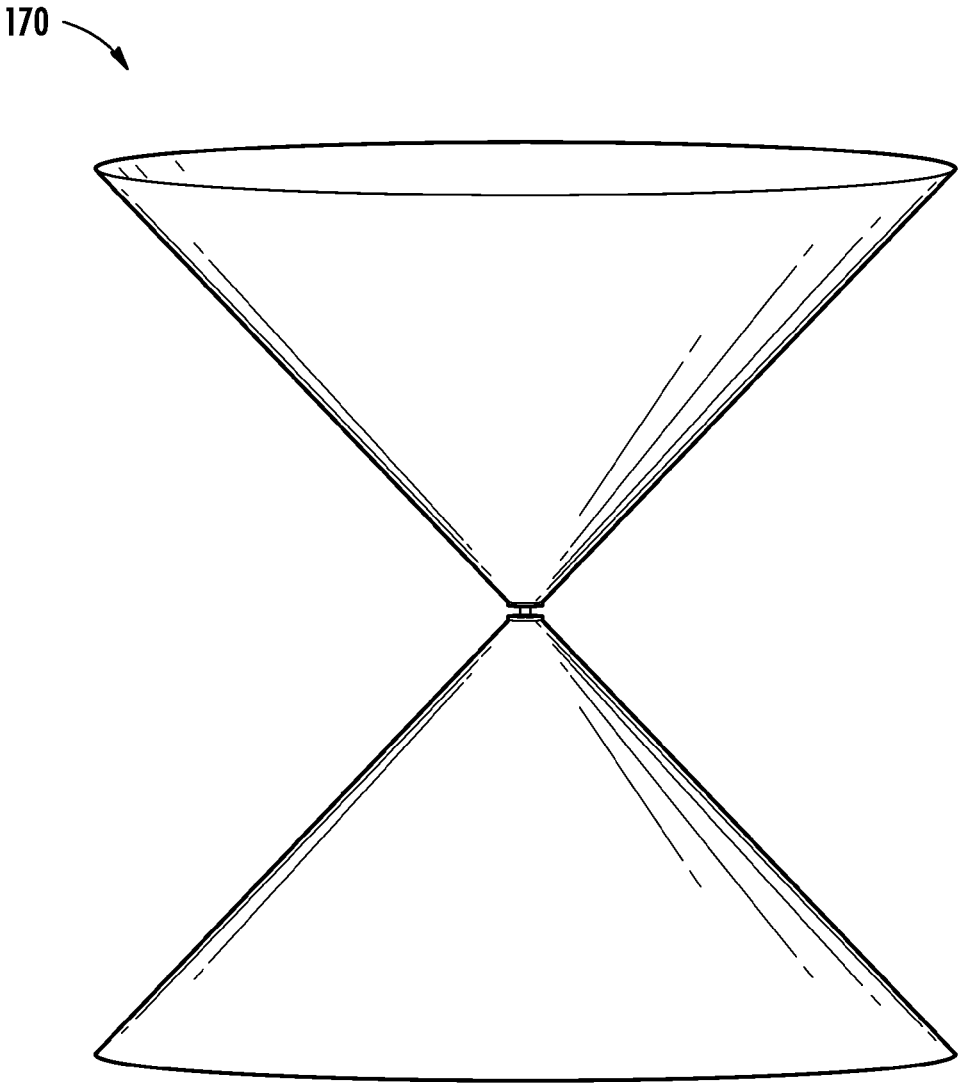
FIG. 1A PRIOR ART
FIG. 1*a* is a schematic view of a biconical antenna in accordance with the prior art.
Figure 1C:
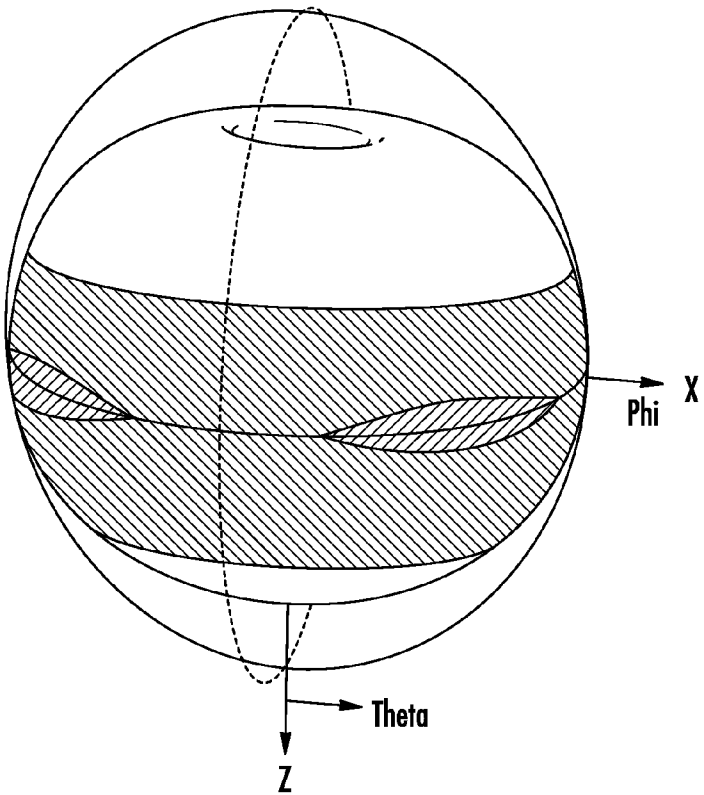
FIG. 1C PRIOR ART
FIGS. 1*b*-1*c* are respective graphs of low and high frequency gain patterns of the biconical antenna of FIG. 1*a*.
Figure 1B:
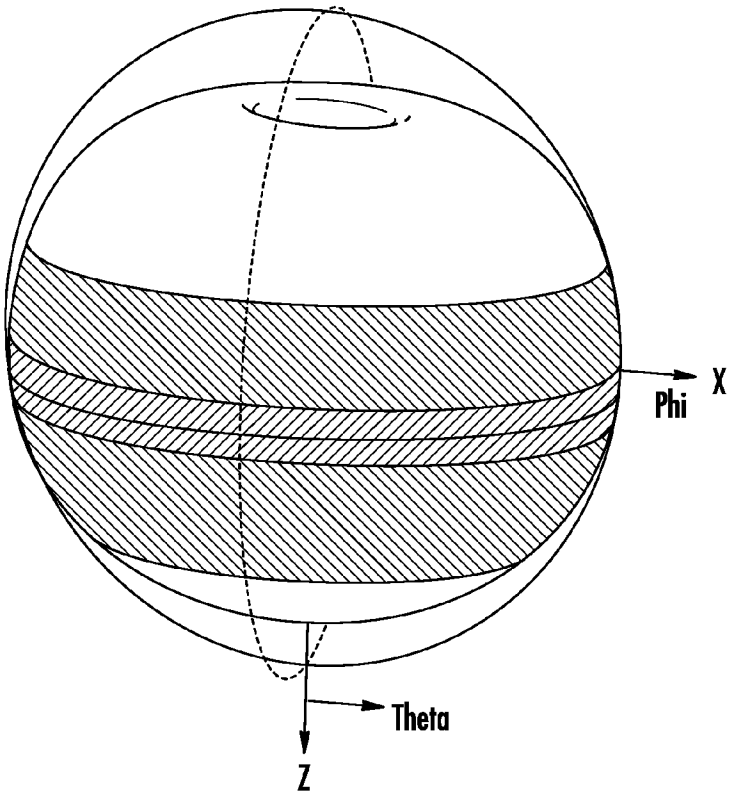
FIG. 1B PRIOR ART
Figure 2A:
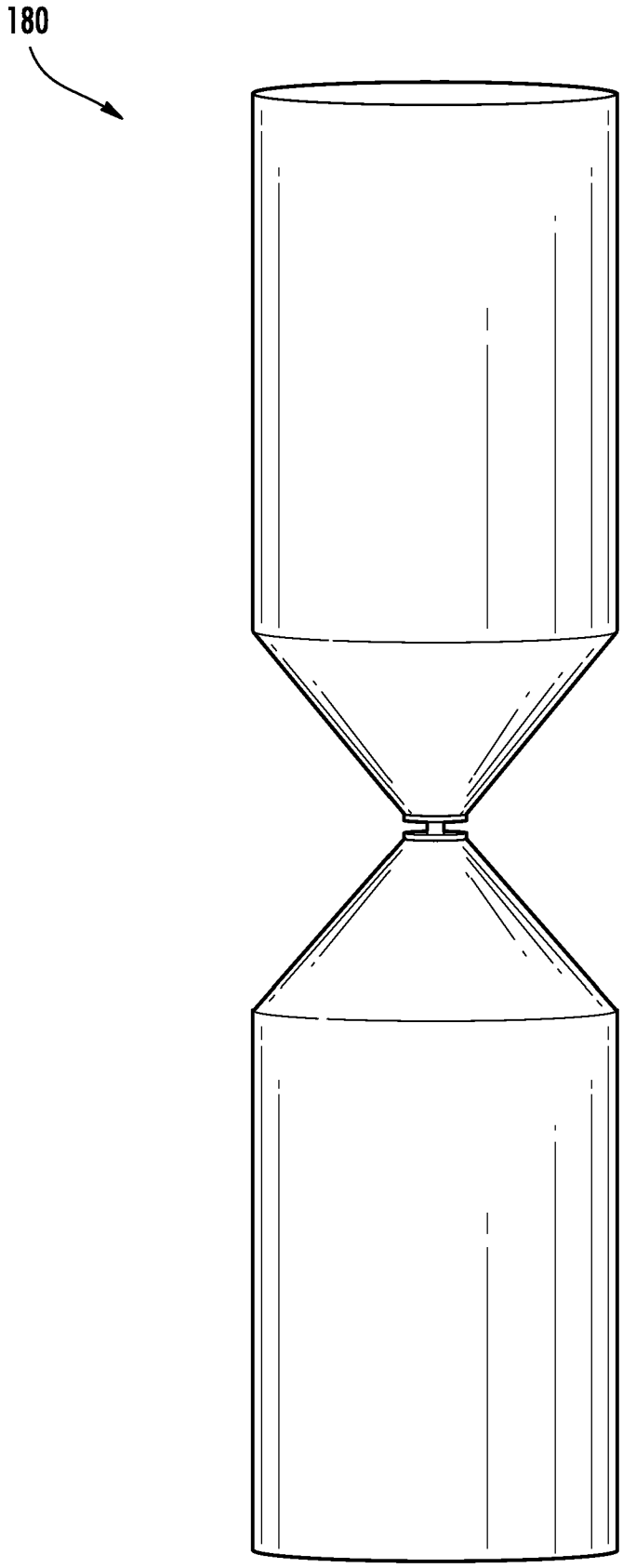
FIG. 2A PRIOR ART
FIG. 2*a* is a schematic view of a truncated biconical antenna in accordance with the prior art.
Figure 2C:
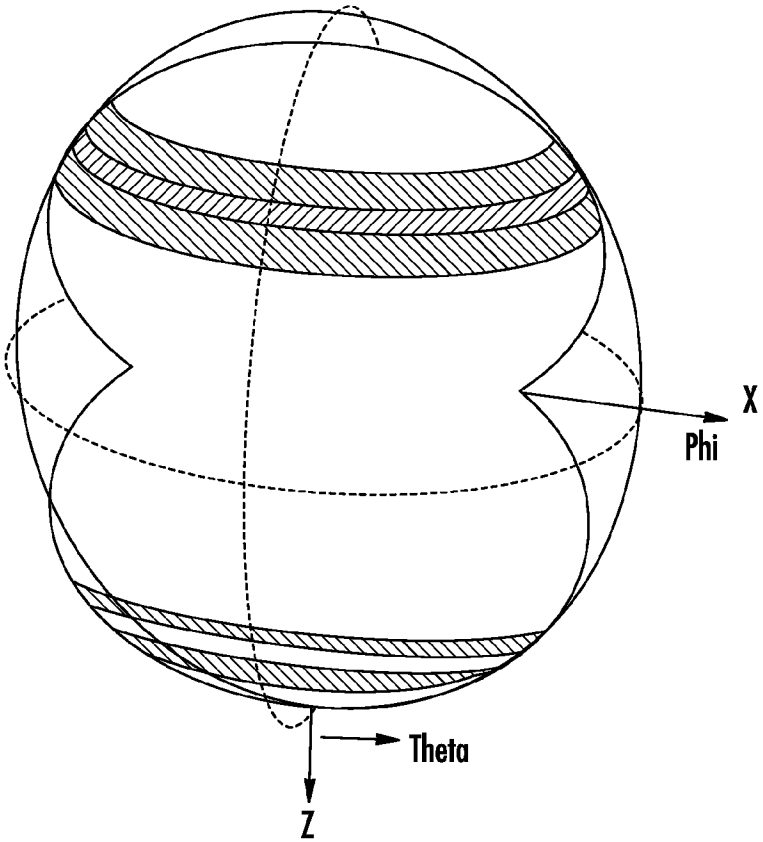
FIG. 2C PRIOR ART
FIGS. 2*b*-2*c* are respective graphs of low and high frequency gain patterns of the truncated biconical antenna of FIG. 2*a*.
Figure 2B:
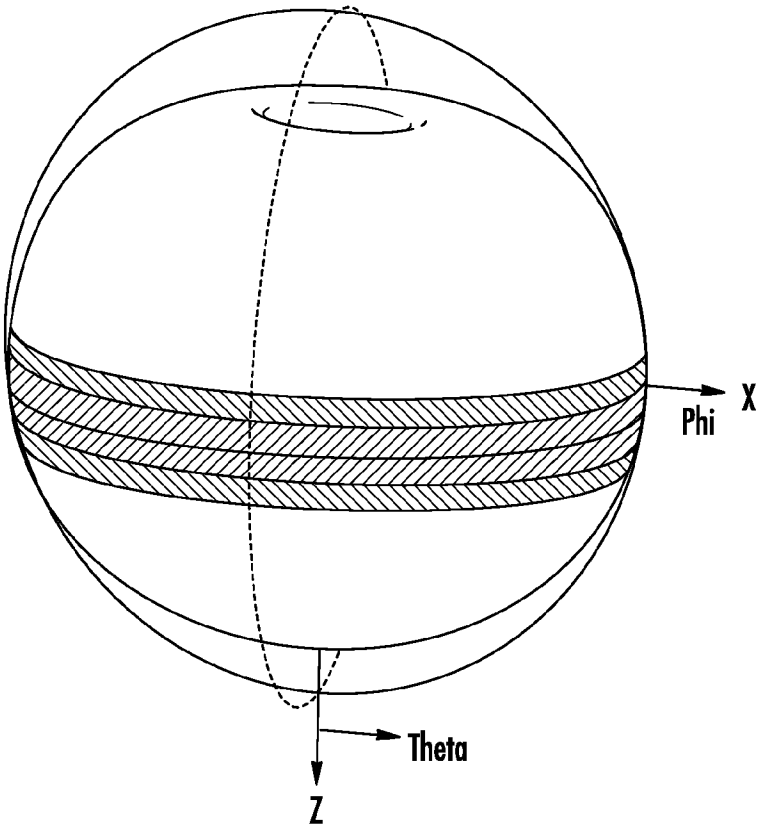
FIG. 2B PRIOR ART
Figure 3:
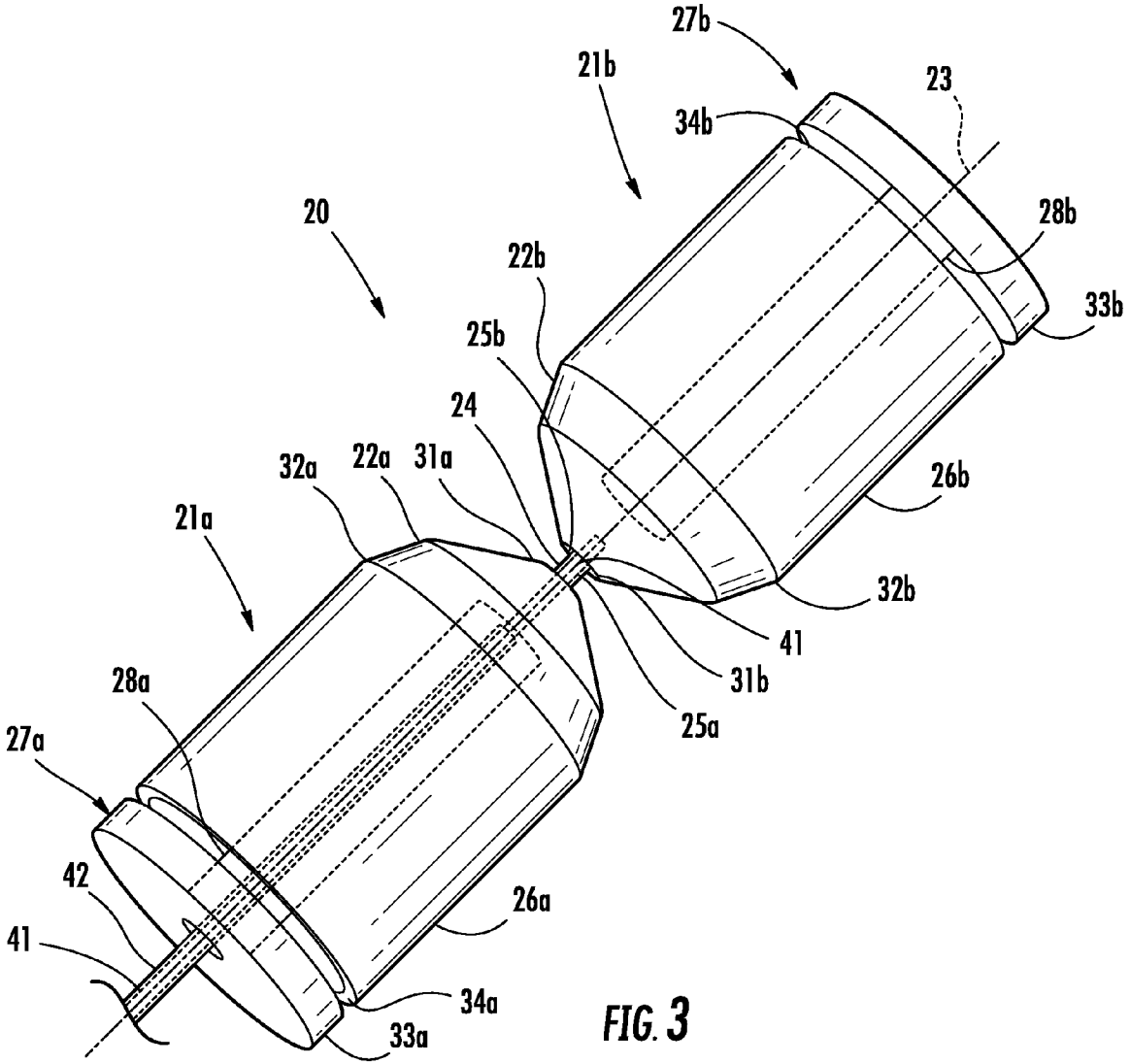
FIG. 3 is a perspective view of an antenna assembly in accordance with the present invention.
Figure 4:
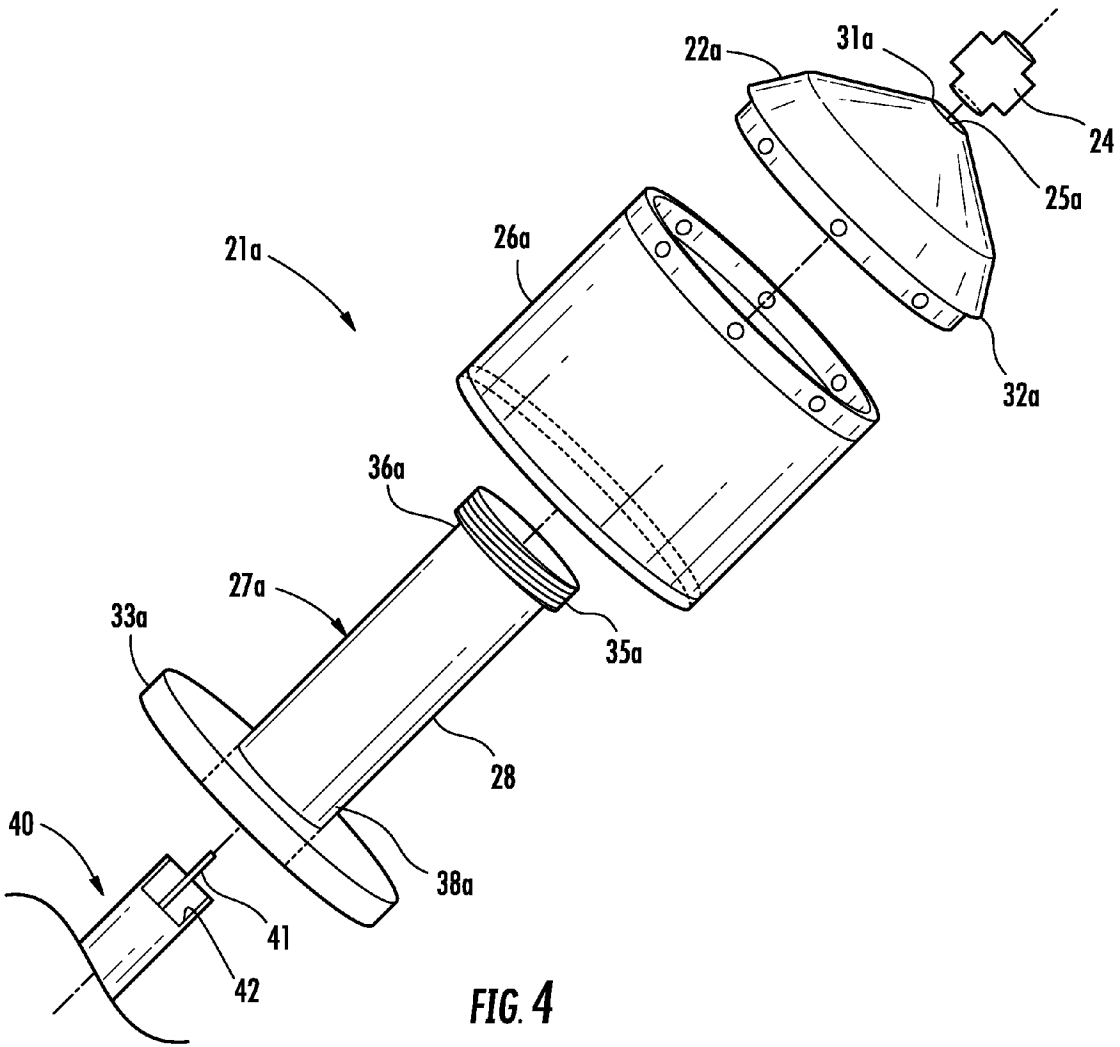
FIG. 4 is a partial exploded view of the antenna of FIG. 3.
Figure 5:
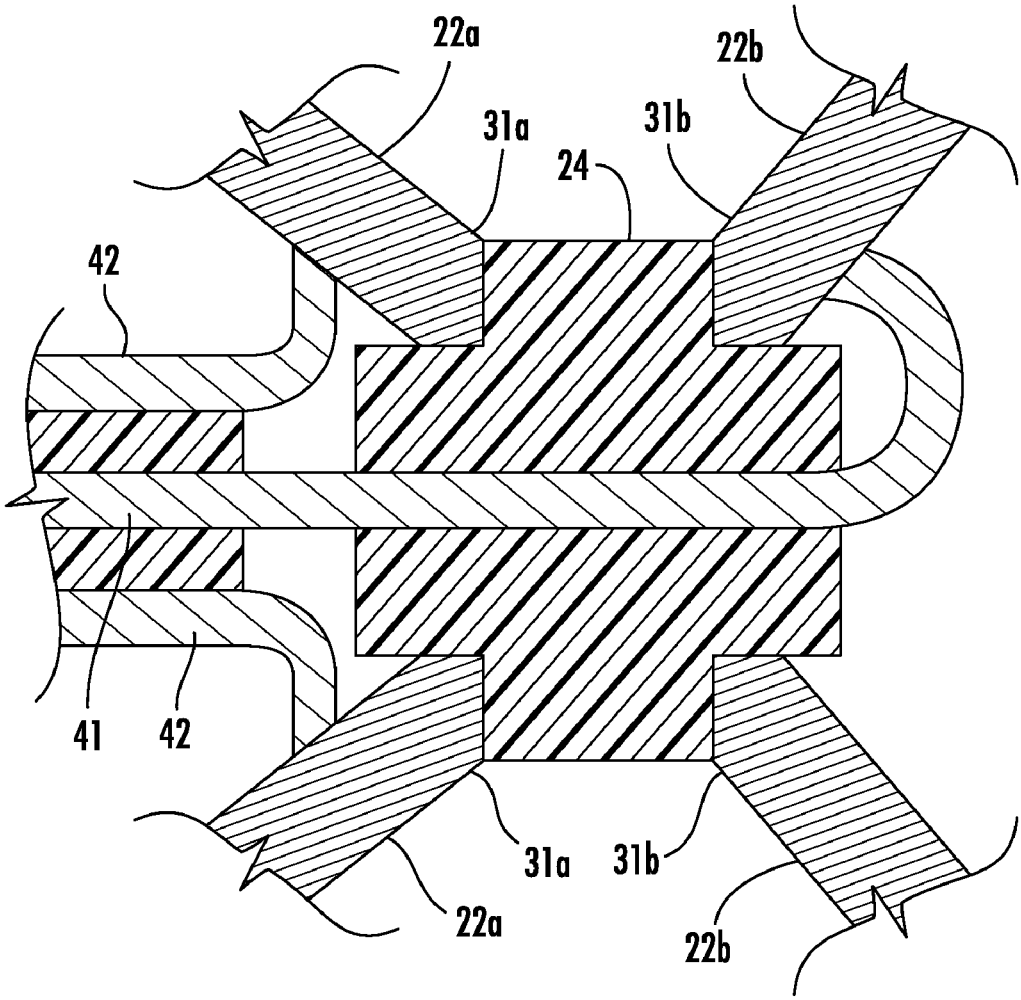
FIG. 5 is a cross-sectional view of a portion of the first and second conical antenna bodies of the antenna of FIG. 3 including a dielectric spacer.

Referring initially to FIGS. 3-5, an antenna assembly 20 includes first and second adjacent antenna elements 21*a*, 21*b*. Each of the first and second adjacent antenna elements 21*a*, 21*b* illustratively includes a conical antenna body 22*a*, 22*b* having a base 32*a*, 32*b* and an apex 31*a*, 31*b* opposite the base.

Each conical antenna body 22*a*, 22*b* illustratively has two-stages defining a step therebetween. As will be appreciated by those skilled in the art, the two-step conical antenna body 22*a*, 22*b* may be used to match a return loss. An approximation of a curve corresponding to a desired return loss at a desired frequency may be accomplished by adding additional stages to form the conical antenna body 22*a*, 22*b*. The two-stage conical antenna body 22*a*, 22*b* provides improved return loss performance over a single-plane conical antenna body. Of course, each conical antenna body 22*a*, 22*b* may be formed having a single stage or more than two stages. Moreover, the stages may be formed to define any shape, but an overall spherical shape of the conical antenna body is less desired, for example, for wideband frequency operation.

An increase in the size or diameter of each conical antenna body 22*a*, 22*b* advantageously increases performance. For example, an increase in the diameter of the base 32*a*, 32*b* of the conical antenna body 22*a*, 22*b* corresponds to an increase in frequency bandwidth. Thus, the diameter of each conical antenna body 22*a*, 22*b* may be determined based upon a compromise of desired size and desired performance.

Each of the first and second adjacent antenna elements 21*a*, 21*b* also includes a cylindrical antenna body 26*a*, 26*b* extending from the base 32*a*, 32*b* of the conical antenna body 22*a*, 22*b*. The cylindrical antenna body 26*a*, 26*b* illustratively is a continuous electrical conductor.

Each of the first and second adjacent antenna elements 21*a*, 21*b* also includes a choke assembly 27*a*, 27*b* that illustratively includes a choke shaft 28*a*, 28*b*. The choke shaft 28*a*, 28*b* has a proximal end 36*a*, 36*b* that is coupled to the conical antenna body 22*a*, 22*b*. The choke shaft 28*a*, 28*b* also includes a distal end 38*a*, 38*b* opposite the proximal end 36*a*, 36*b*. The choke assembly 27*a*, 27*b* also includes a choke member 33*a*, 33*b* carried by the distal end 38*a*, 38*b* of the choke shaft 28*a*, 28*b* in longitudinally spaced relation from an opposing end of the cylindrical antenna body 26*a*, 26*b* to define the choke slot 34*a*, 34*b*.

The proximal end 36*a*, 36*b* of the choke shaft 28*a*, 28*b* and the opposing portions of the conical antenna body 22*a*, 22*b* cooperate to define an adjustable length connection to permit adjustment of the choke slot 34*a*, 34*b*. Illustratively, the adjustable length connection includes a threaded connection 35*a*, 35*b* so that the choke slot 34*a*, 34*b* may be adjusted by threading the choke shaft 28*a*, 28*b* in or out of the corresponding threaded portion 35*a*, 35*b* of the conical antenna body 27*a*, 27*b*. For example, the distance of the choke slot 34*a*, 34*b* may be adjusted so that a length of the overall first and/or second antenna elements 21*a*, 21*b* correspond to a half-wavelength of a desired operating frequency. Other types of adjustable connections may be used. In some embodiments (not shown), the distance of the choke slot 34*a*, 34*b* may be fixed.

The longitudinally spaced distance between the choke member 33*a*, 33*b* from the opposing end of the cylindrical antenna body 26*a*, 26*b* advantageously affects the performance of the antenna. For example, the longitudinally spaced distance between the choke member 33*a*, 33*b* from the opposing end of the cylindrical antenna body 26*a*, 26*b* affects the radiation pattern and/or return loss by altering the location of lobes in the gain pattern.

Additional choke members (not shown) may be included in the choke assembly 27*a*, 27*b* to define a plurality of choke slots 34*a*, 34*b*. Thus additional lobe control may be provided. Reduction of "lobing" at other or additional frequencies may be accomplished by adjusting the length of the choke shaft 28*a*, 28*b*, and thus shifting the location of the choke slot 34*a*, 34*b* relative to the center of the antenna assembly 20. Moreover, the length of the choke shaft 28*a*, 28*b* may change based upon a desired operating frequency, bandwidth, return loss, and lobe location, for example. Other factors may be considered in determining the number and location of choke members and thus choke slots.

The conical antenna body 22*a* of the first antenna element 21*a* has an opening 25*a* at the apex 31*a* thereof. A tubular dielectric spacer 24 is positioned in the opening 25*a* for receiving an inner conductor 41 of a coaxial cable 40, or other conductor, for example. The conical antenna body 22*b* of the second antenna element 21*b* may be similarly configured with an opening 25*b* at an apex 31*b* thereof, and may have a connector (not shown) therein for receiving the inner conductor 41.

The choke shaft 28*a* of the first antenna element 21*a* is hollow. The coaxial cable 40 extends through the hollow choke shaft 28*a*. The inner conductor 41 is coupled to the conical antenna body 22*b* of the second antenna element 21*b* (FIG. 5). The inner conductor 41 passes through the tubular dielectric spacer 24 in the apex 31*a* of the first antenna element 21*a* to couple with the conical antenna body 22*b* of the second antenna element 21*b*. A coaxial cable connector (not shown) may be included in the conical antenna body 22*b* of the second antenna element 21*b* for coupling to the center conductor 41.

The coaxial cable 40 also includes an outer conductor 42 surrounding the inner conductor 41 and coupled to the cylindrical antenna body 26*a* of the first antenna element 21*a* (FIG. 5). Other types of conductors may extend through the hollow choke shaft, for example a rigid conductor, which may be formed as part of the choke assembly. Additionally, the second choke shaft 28*b* may also be hollow, thus reducing manufacturing costs by reducing the amount of material used and the machining of two different choke assemblies. In some embodiments, the choke shafts 28*a*, 28*b* may not be hollow.

Each of the first and second conical antenna bodies 22*a*, 22*b* are illustratively aligned along a common longitudinal axis 23 with respective apexes 31*a*, 31*b* in opposing relation to define a symmetrical biconical dipole antenna.

The overall height of the first and second adjacent antenna elements 21*a*, 21*b* is typically determined by the desired operating frequency. The height of the antenna may also be determined based upon a size limitation of a device housing, for example.

Additionally, as a desired frequency increases across a desired bandwidth, the choke assembly 27*a*, 27*b* acts as an inductor at relatively lower frequencies so that the radio frequency (RF) signal "sees" the entire height of the first and second antenna elements, i.e. the conical antenna bodies 22*a*, 22*b*, the cylindrical antenna bodies 26*a*, 26*b*, and the choke members 33*a*, 33*b*. In contrast, at relatively high frequencies, the RF signal "sees" the smaller portions of the antenna, i.e. the conical antenna bodies 22*a*, 22*b* and the cylindrical antenna bodies 26*a*, 26*b*. This advantageously helps to shape and control the gain pattern or lobes in the gain pattern for a desired application, for example ultra-wideband communications.

The antenna assembly 20 may further include a balun (not shown). A balun may be desired based upon how the coaxial cable 40 or conductor is attached to the conical antenna body 22*a*, 22*b*. The balun may advantageously balance the RF signals in each of the first and second adjacent antenna elements 21*a*, 21*b*.

Figure 6:
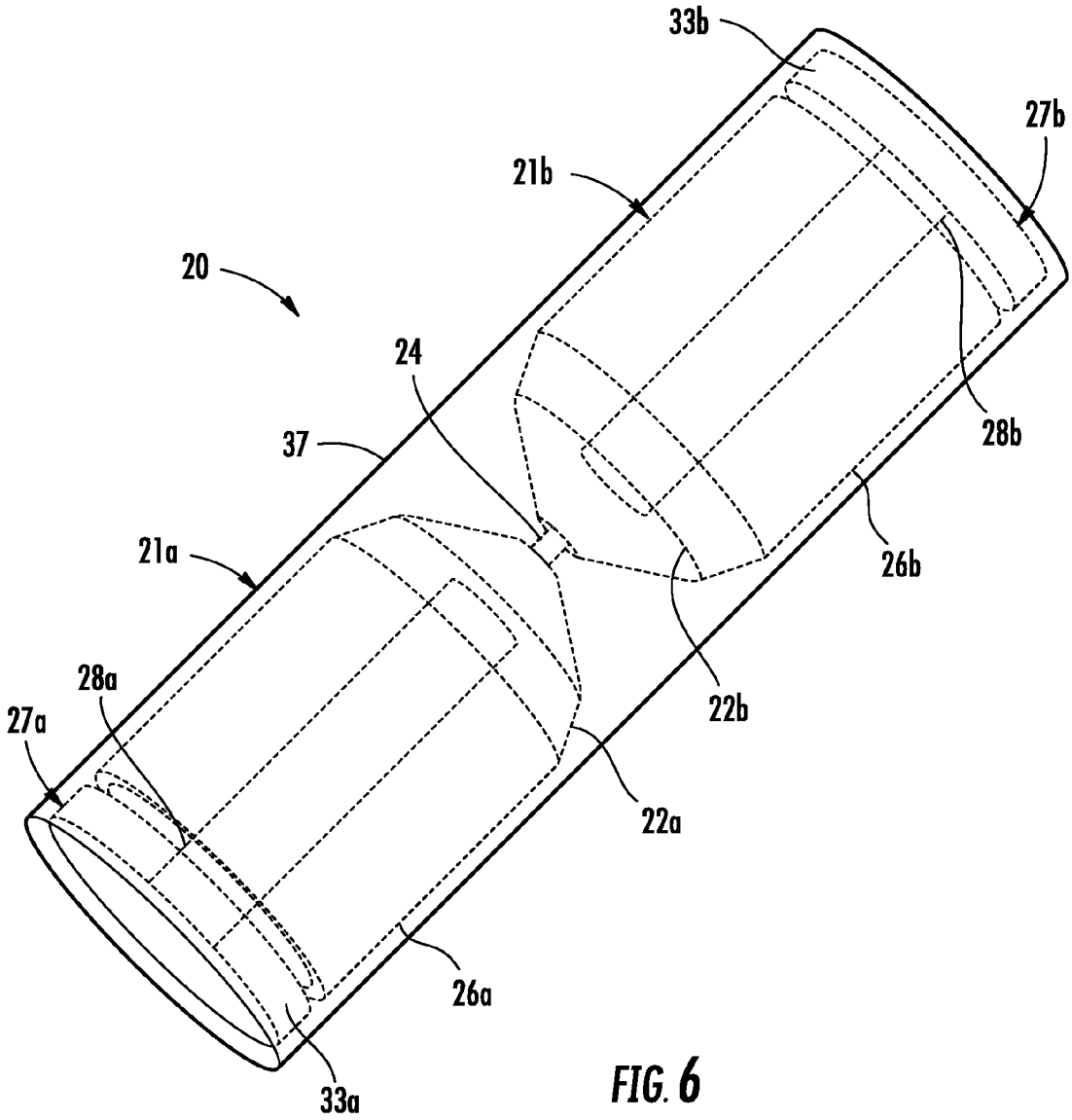
FIG. 6 is a perspective view of the antenna assembly of FIG. 3 including a dielectric cylindrical body.

Referring now to FIG. 6, the antenna assembly 20 further includes a dielectric cylindrical body 37 surrounding the pair of first and second adjacent antenna elements. The dielectric cylindrical body 37 may provide additional rigidity to the antenna assembly 20 with reduced affect on the antenna assembly performance. The dielectric cylindrical body 37 may be used in any of the embodiments described herein.

Figure 7B:
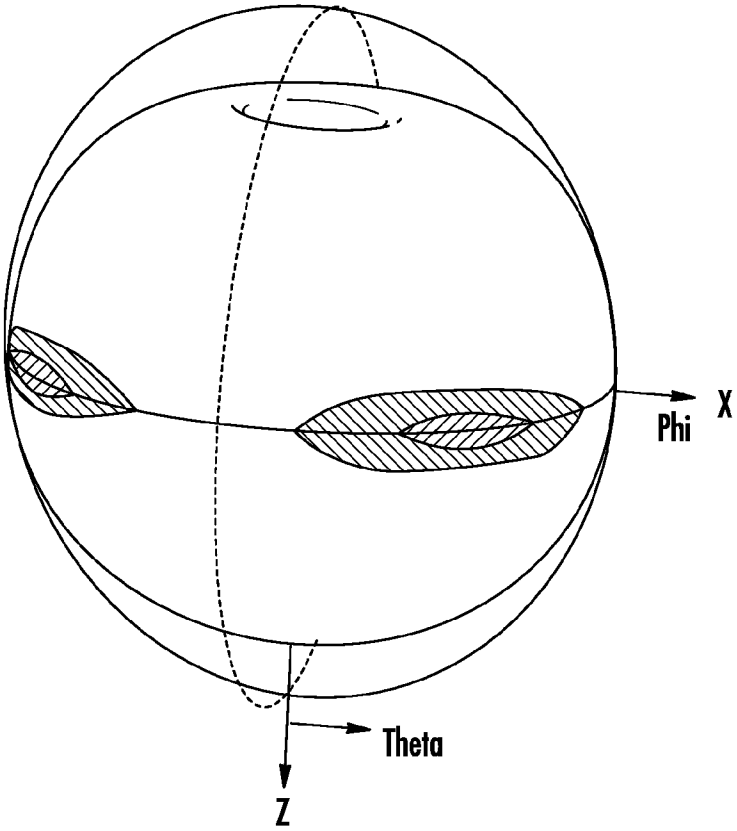
FIGS. 7*a*-7*b* are respective graphs of low and high frequency gain patterns of the antenna of FIG. 3.
Figure 7A:
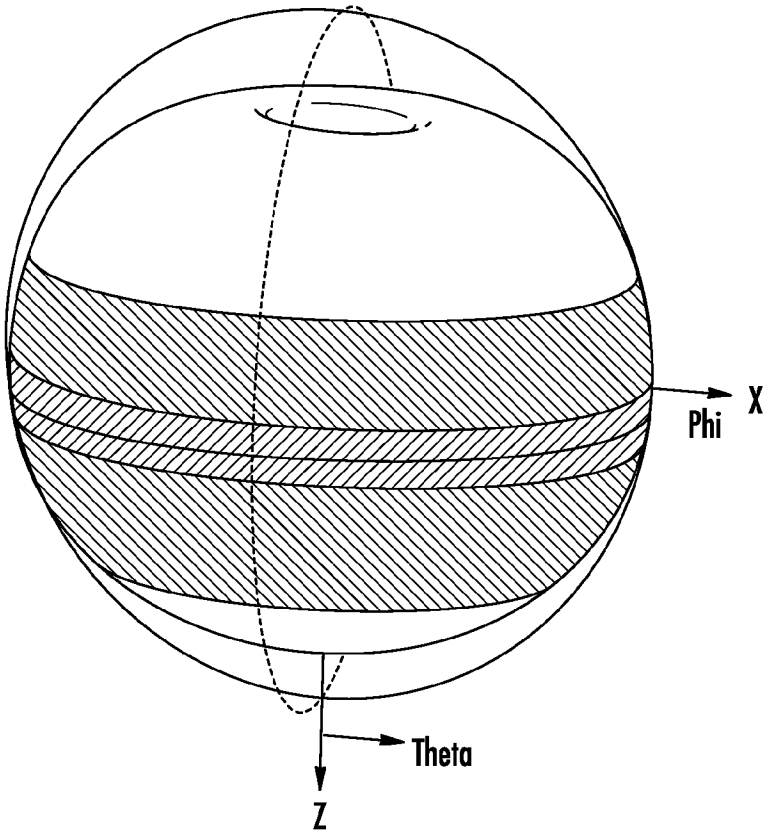

Referring now to the graphs in FIGS. 7*a* and 7*b*, the choke slot 34*a*, 34*b* advantageously reduces "lobing" at certain frequencies, thus reducing nulls in the radiation pattern of the antenna assembly 20 that are located on the horizon, for example. The gain patterns in the graphs illustratively have improved performance over the prior art antennas, whose gain patterns are illustrated in the graphs of FIGS. 1*b*, 1*c*, 2*b*, and 2*c*.

Figure 8:
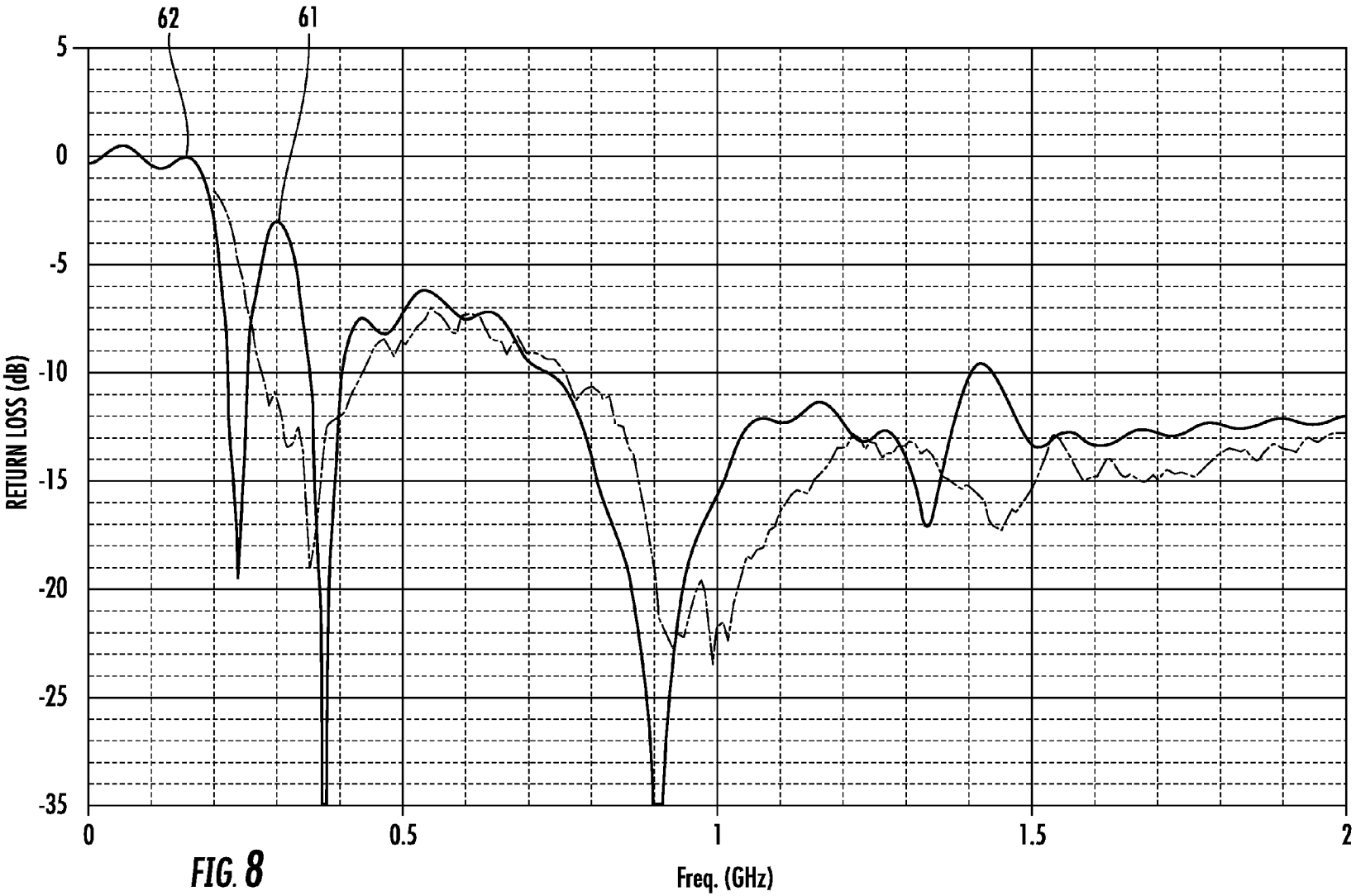
FIG. 8 is a graph of measured return loss versus simulated return loss for the antenna of FIG. 3.

A antenna assembly was formed to have a height of 15.5 inches and a diameter of 4 inches. The antenna assembly exhibits operation from 225 MHz to 2 GHz with reduced or no nulls on the horizon, for example as illustrated in the graphs of FIGS. 7*a* and 7*b*. In contrast, a prior art antenna, without the choke slots, exhibited nulls between 800 and 900 MHz. Referring additionally to the graph of FIG. 8, measured return loss 61 versus simulated return loss 62 for the prototype antenna assembly is illustrated.

Accordingly, the antenna assembly 20 may be particularly advantageous in a frequency range of about 225 MHz to 2 GHz, and in ultra-wideband applications, for example. Of course, the antenna assembly 20 may be used for other frequency ranges and other applications.

Figure 9:
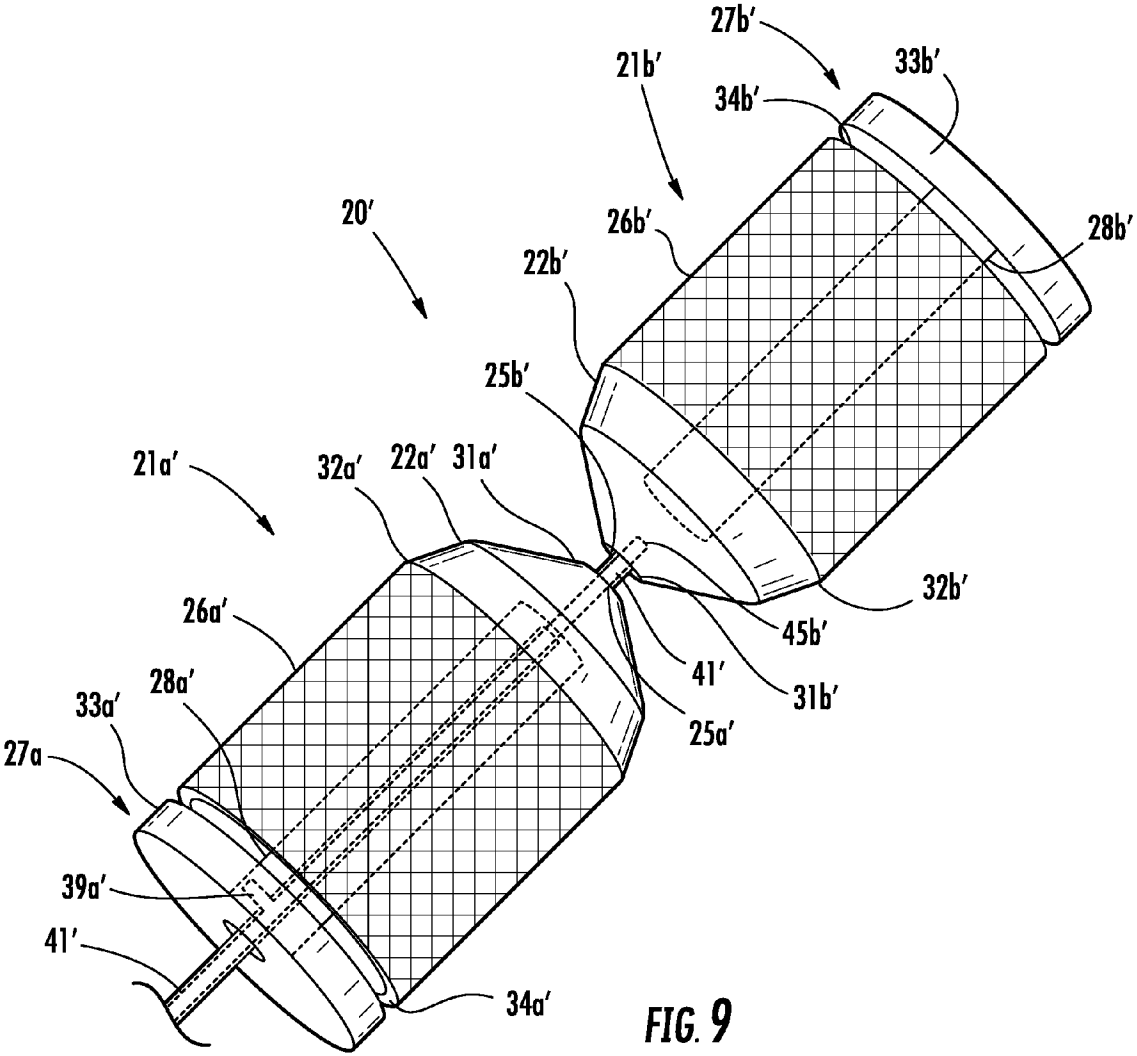
FIG. 9 is a perspective view of another embodiment of an antenna assembly in accordance with the present invention.

Referring now to FIG. 9, the illustrated embodiment of the cylindrical antenna body 26*a*', 26*b*' is a mesh electrical conductor. If openings in the mesh electrical conductor 26*a*', 26*b*' are small enough, effects of the cylindrical antenna body, for example, on gain and return loss, may be reduced. Other portions of the antenna assembly 20' may include mesh, for example to reduce overall weight.

Additionally, the hollow choke shaft 28*a*' of the first antenna element 21*a*' defines a first antenna feed point 39*a*'. A conductor 41' extends through the hollow choke shaft 28*a*' and is coupled to the conical antenna body 22*b*' of the second antenna element 21*b*' to define a second antenna feed point 45*b*'. In other words, this arrangement is an alternative to the coaxial cable feed described above.

Figure 10:
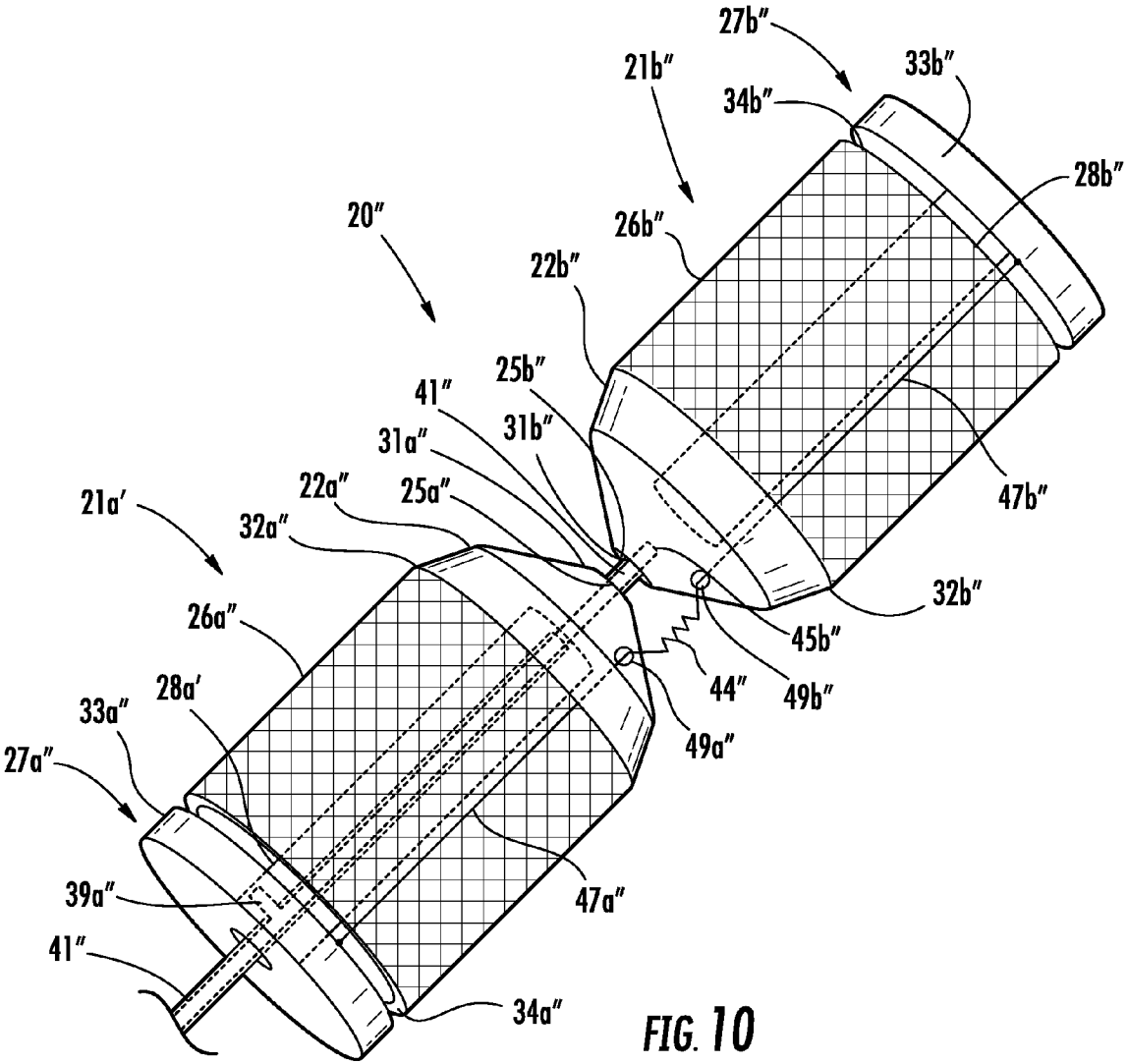
FIG. 10 is a perspective view of another embodiment of an antenna assembly in accordance with the present invention.

Referring now to FIG. 10, the illustrated embodiment of the antenna assembly 20" extends the usable frequency range of the antenna assembly 20 to relatively low frequencies that may approach DC, for example. The antenna assembly 20" advantageously trades increased VSWR bandwidth below cutoff for a reduction in realized gain above cutoff, such as for when VSWR bandwidth requirements exceed fundamental limitations of relative size and 100% radiation efficiency.

A resistor 44", which may be a non-inductive resistor, is connected to the distal points of the antenna assembly 20" by insulated conductive wires 47*a*", 47*b*". The insulated conductive wires 47*a*", 47*b*" enter and exit the antenna assembly 20" through respective openings 49*a*", 49*b*" in each of the conical antenna bodies 22*a*", 22*b*". The resistor 44" may be between about 50 to 200 Ohms, however, 50 Ohms may be preferential for many applications. A higher resistance value may provide a lower VSWR near cutoff, while 50 Ohms may provide a lower VSWR near DC.

For example, when the resistor 44" is 100 Ohms, the gain may be reduced by about 2 dB above the antenna's lower cutoff frequency in exchange for lower VSWR below cutoff. Antennas, including conical half-elements may be high pass in nature, as they may exhibit relatively low VSWR at most frequencies above a lower threshold known as the cutoff frequency. The conductive wires 47*a*", 47*b*" advantageously provide an internal electrical fold connection for the resistor 44".

Figure 11:
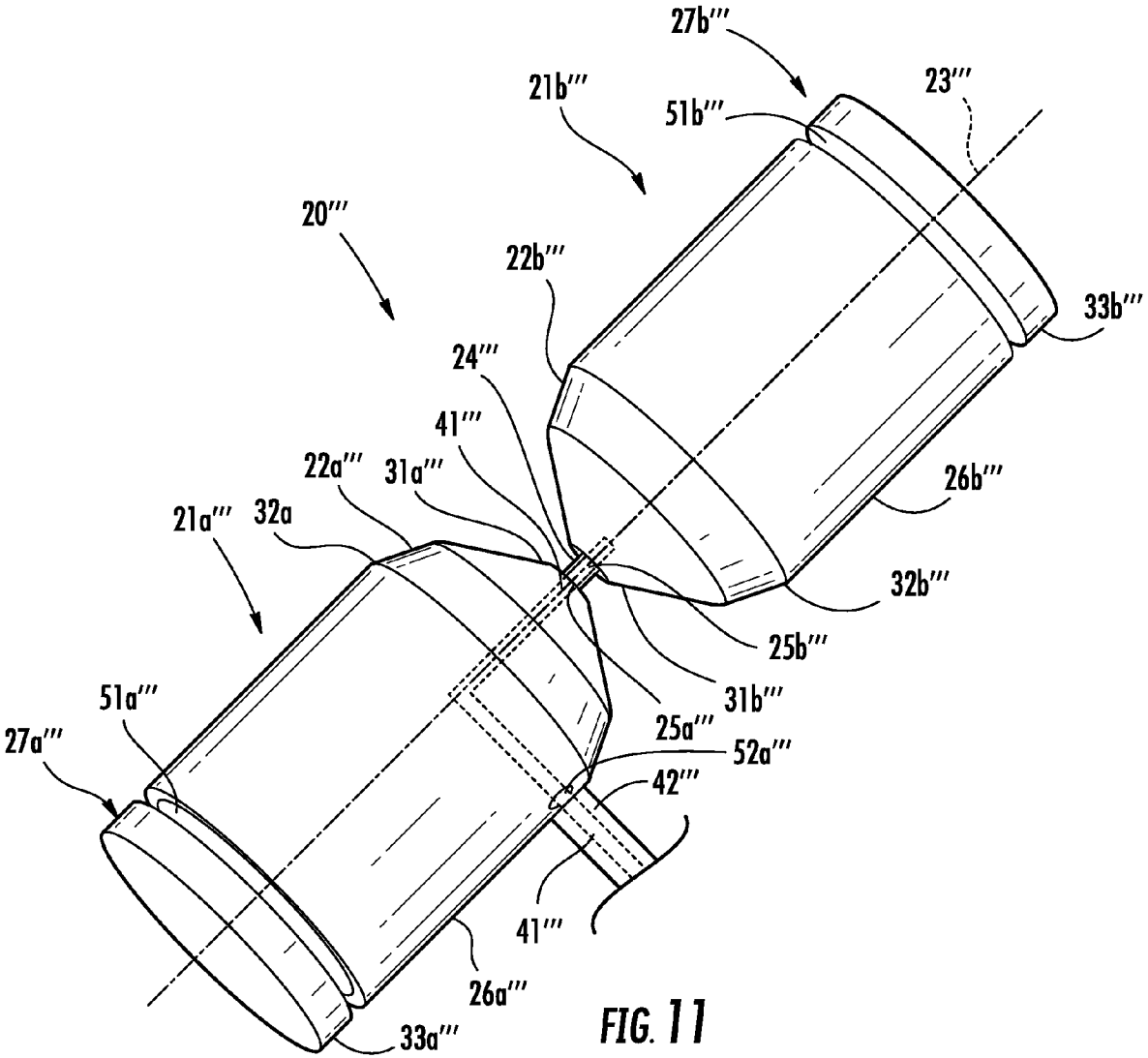
FIG. 11 is a perspective view of another embodiment of an antenna assembly in accordance with the present invention.

Referring now to FIG. 11, the illustrated embodiment of the of the antenna assembly 20'" includes a choke assembly 27*a*'", 27*b*'" that includes a dielectric spacer 51*a*'", 51*b*'" positioned between the cylindrical antenna body 26*a*'", 26*b*'" and the choke member 33*a*'", 33*b*'". In other words, the choke member 33*a*'", 33*b*'" is longitudinally spaced from the end of the cylindrical antenna body opposing the conical antenna body 22*a*'", 22*b*'" to define a choke slot. The dielectric spacer 51*a*'", 51*b*'" is positioned within the choke slot. The dielectric spacer 51$a'''$, 51$b'''$ may be a polytetrafluoroethylene spacer, for example, a Teflon™ spacer as Teflon™ has a dielectric constant that is near the dielectric constant of air.

Additionally, the choke member 31$a'''$, 31$b'''$ may not include an opening therein. Instead, one of the cylindrical antenna bodies 26$a'''$, 26$b'''$ may include an opening 52$a'''$ adjacent the respective conical antenna body 22$a'''$, 22$b'''$ to allow the inner conductor 41''' of the coaxial cable 40''' to pass through and extend to the opening 25$a'''$. In some embodiments, except for the opening 52$a'''$, the cylindrical antenna bodies 26$a'''$, 26$b'''$ may be solid.

A method aspect is directed to a method of making an antenna assembly 20. The method includes forming first and second adjacent antenna elements 21$a$, 21$b$. The first and second antenna elements 21$a$, 21$b$ include a conical antenna body 22$a$, 22$b$ having a base 32$a$, 32$b$ and an apex 31$a$, 31$b$ opposite the base, a cylindrical antenna body 26$a$, 26$b$ extending from the base of the conical antenna body, and a choke assembly 27$a$, 27$b$. The choke assembly 27$a$, 27$b$ includes a choke shaft 28$a$, 28$b$ having a proximal end 36$a$, 36$b$ coupled to the conical antenna body 22$a$, 22$b$ and a distal end 38$a$, 38$b$ opposite the proximal end. The choke assembly 27$a$, 27$b$ also includes at least one choke member 33$a$, 33$b$ carried by the distal end 38$a$, 38$b$ of the choke shaft 28$a$, 28$b$ in longitudinally spaced relation from an opposing end of the cylindrical antenna body 26$a$, 26$b$ to define at least one choke slot 34$a$, 34$b$. The method further includes aligning each of the first and second conical antenna bodies 22$a$, 22$b$ along a common longitudinal axis 23 with respective apexes 31$a$, 31$b$ in opposing relation to define a symmetrical biconical dipole antenna.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly comprising:

first and second adjacent antenna elements each comprising a conical antenna body having a base and an apex opposite the base, a cylindrical antenna body extending from the base of said conical antenna body, and a choke assembly comprising a mounting member and at least one choke member carried by said mounting member in longitudinally spaced relation from an opposing end of said cylindrical antenna body to define a choke slot;

each of said first and second conical antenna bodies aligned along a common longitudinal axis with respective apexes in opposing relation to define a symmetrical biconical dipole antenna.

2. The antenna assembly according to claim 1, wherein said mounting member comprises a choke shaft having a proximal end coupled to said conical antenna body and a distal end opposite the proximal end, and wherein said at least one choke member is carried by the distal end of said choke shaft.

3. The antenna assembly according to claim 1 wherein said mounting member comprises a dielectric spacer.

4. The antenna assembly according to claim 2, wherein the proximal end of said choke shaft and opposing portions of said conical antenna body define an adjustable length connection to permit longitudinal adjustment of the choke slot.

5. The antenna assembly according to claim 4, wherein the adjustable length connection comprises a threaded connection.

6. The antenna assembly according to claim 2, wherein said choke shaft of said first antenna element comprises a hollow choke shaft defining a first antenna feed point; and further comprising a conductor extending through said hollow choke shaft and coupled to said conical antenna body of said second antenna element to define a second antenna feed point.

7. The antenna assembly according to claim 2, wherein said choke shaft of said first antenna element comprises a hollow choke shaft; and further comprising a coaxial cable extending through said hollow choke shaft; and wherein said coaxial cable comprises an inner conductor coupled to said conical antenna body of said second antenna element, and an outer conductor surrounding said inner conductor and coupled to said cylindrical antenna body of said first antenna element.

8. The antenna assembly according to claim 7, wherein said conical antenna body of said first antenna element has an opening at the apex thereof; and further comprising a tubular dielectric spacer positioned in the opening and receiving the inner conductor of said coaxial cable.

9. The antenna assembly according to claim 1, wherein said cylindrical antenna body comprises a mesh electrical conductor.

10. The antenna assembly according to claim 1, wherein said cylindrical antenna body comprises a continuous electrical conductor.

11. The antenna assembly according to claim 1, further comprising a dielectric cylindrical body surrounding said pair of first and second adjacent antenna elements.

12. The antenna assembly according to claim 1, further comprising a resistor coupled to said first and second at least one choke members.

13. An antenna assembly comprising:

first and second adjacent antenna elements each comprising a conical antenna body having a base and an apex opposite the base, a cylindrical mesh electrical conductor extending from the base of said conical antenna body, and a choke assembly comprising a choke shaft having a proximal end coupled to said conical antenna body and a distal end opposite the proximal end, and at least one choke member carried by the distal end of said choke shaft in longitudinally spaced relation from an opposing end of said cylindrical mesh electrical conductor to define a choke slot, the proximal end of said choke shaft and opposing portions of said conical antenna body defining an adjustable length connection to permit longitudinal adjustment of the choke slot;

each of said first and second conical antenna bodies aligned along a common longitudinal axis with respective apexes in opposing relation to define a symmetrical biconical dipole antenna.

14. The antenna assembly according to claim 13, wherein the adjustable length connection comprises a threaded connection.

15. The antenna assembly according to claim 13, wherein said choke shaft of said first antenna element comprises a hollow choke shaft defining a first antenna feed point; and further comprising a conductor extending through said hollow choke shaft and coupled to said conical antenna body of said second antenna element to define a second antenna feed point.

16. The antenna assembly according to claim 13, wherein said choke shaft of said first antenna element comprises a hollow choke shaft; and further comprising a coaxial cable extending through said hollow choke shaft; and wherein said coaxial cable comprises an inner conductor coupled to said conical antenna body of said second antenna element, and an outer conductor surrounding said inner conductor and coupled to said cylindrical antenna body of said first antenna element.

17. The antenna assembly according to claim 16, wherein said conical antenna body of said first antenna element has an opening at the apex thereof; and further comprising a tubular dielectric spacer positioned in the opening and receiving the inner conductor of said coaxial cable.

18. The antenna assembly according to claim 13, further comprising a dielectric cylindrical body surrounding said pair of first and second adjacent antenna elements.

19. A method of making antenna assembly comprising:

forming first and second adjacent antenna elements, comprising a conical antenna body having a base and an apex opposite the base, a cylindrical antenna body extending from the base of the conical antenna body, and a choke assembly comprising a mounting member and at least one choke member carried by said mounting member in longitudinally spaced relation from an opposing end of the cylindrical antenna body to define a choke slot; and aligning each of the first and second conical antenna bodies along a common longitudinal axis with respective apexes in opposing relation to define a symmetrical biconical dipole antenna.

20. The method according to claim 19, wherein forming the first and second adjacent antenna elements to include the choke assembly including the mounting member comprises forming the first and second adjacent antenna elements to include the choke assembly including a choke shaft having a proximal end coupled to the conical antenna body and a distal end opposite the proximal end, and wherein the at least one choke member is carried by the distal end of the choke shaft.

21. The method according to claim 19, wherein forming the first and second adjacent antenna elements to include the mounting member comprises forming the first and second adjacent antenna elements to include a dielectric spacer.

22. The method according to claim 20, wherein forming the first and second adjacent antenna elements comprises forming the first and second adjacent antenna elements so that the proximal end of the choke shaft and opposing portions of the conical antenna body define an adjustable length connection to permit longitudinal adjustment of the at least one choke slot.

23. The method according to claim 20, wherein forming the first and second adjacent antenna elements comprises forming the first and second antenna elements so that the choke shaft of the first antenna element comprises a hollow choke shaft; and further comprising coupling a coaxial cable to extend through the hollow choke shaft; and wherein coupling the coaxial cable comprises coupling an inner conductor to the conical antenna body of second antenna element, and coupling an outer conductor surrounding the inner conductor to the cylindrical antenna body of the first antenna element.

24. The method according to claim 23, further comprising positioning a tubular dielectric spacer in an opening at the apex of the conical antenna body of the first antenna element and receiving the inner conductor of the coaxial cable.

25. The method according to claim 19, wherein forming the first and second adjacent antenna elements comprises forming the forming the first and second antenna elements so that the cylindrical antenna body comprises a mesh electrical conductor.

26. The method according to claim 19, wherein forming the first and second adjacent antenna elements comprises forming the first and second adjacent elements so that the cylindrical antenna body comprises a continuous electrical conductor.

27. The method according to claim 19, further comprising coupling a dielectric cylindrical body to surround the pair of first and second adjacent antenna elements.

* * * * *